US006106764A

United States Patent [19]

Ebner

[11] Patent Number: 6,106,764

[45] Date of Patent: Aug. 22, 2000

[54] APPARATUS FOR SCAVENGING COLD-DRAWN, COIL-FORMING TUBES IN A ROLLER HEARTH FURNACE

[76] Inventor: Peter Ebner, Bergham 168, A-4060 Leonding, Austria

[21] Appl. No.: 09/086,854

[22] Filed: May 29, 1998

[30] Foreign Application Priority Data

Jun. 6, 1997 [AT] Austria ..... 970/97

[51] Int. Cl.[7] ..... C21D 1/06

[52] U.S. Cl. ..... 266/257; 266/251

[58] Field of Search ..... 266/251, 252, 266/257, 274; 148/633, 634, 591

[56] References Cited

U.S. PATENT DOCUMENTS 4,398,971 8/1983 Peterson ..... 148/633

FOREIGN PATENT DOCUMENTS 390 214 9/1989 Austria .
26 17 406 11/1976 Germany .
30 04 455 8/1980 Germany .
31 19 539 12/1982 Germany .

*Primary Examiner*—Scott Kastler
*Attorney, Agent, or Firm*—Collard & Roe, P.C.

[57] ABSTRACT

In a roller hearth furnace there is provided an apparatus for scavenging cold-drawn, coil-forming tubes. An essential element thereof is a pressure vessel (1; 1*a*) serving as reservoir for the scavenging agent, comprising a small calculable outlet opening (2) and a coupling member (3) connected with the tube coil (4).

2 Claims, 1 Drawing Sheet

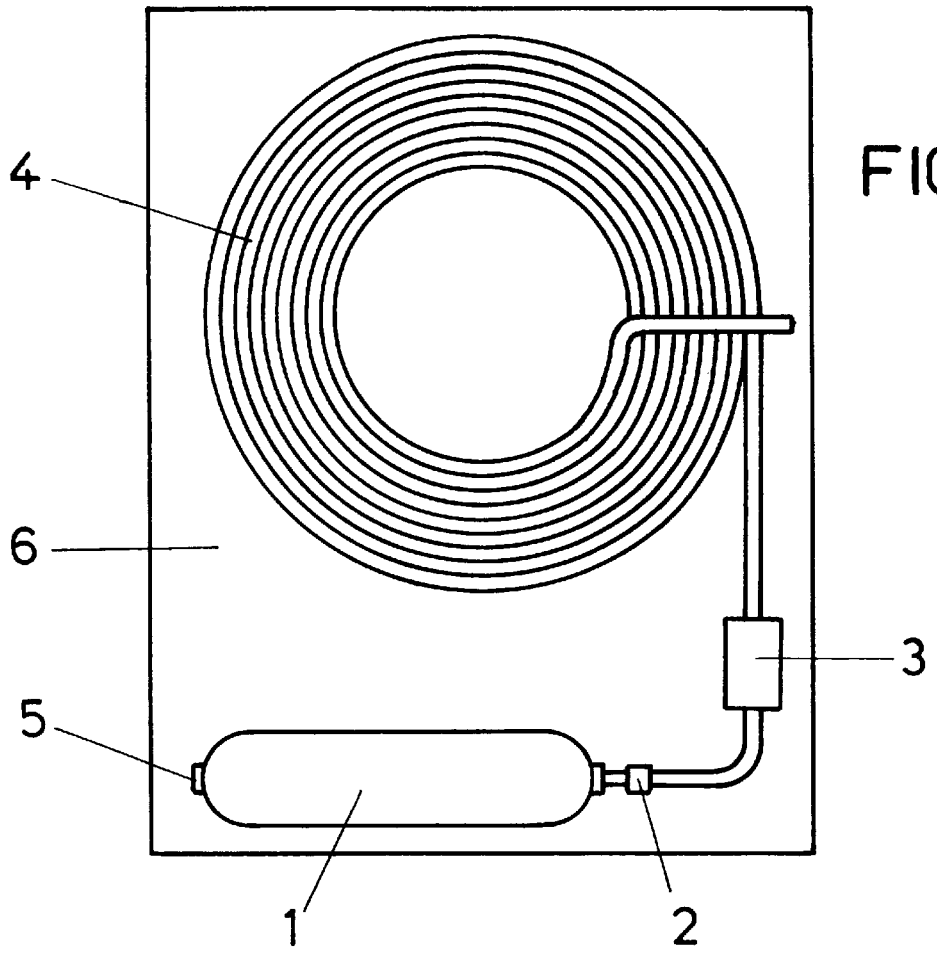
FIG.1
FIG.2
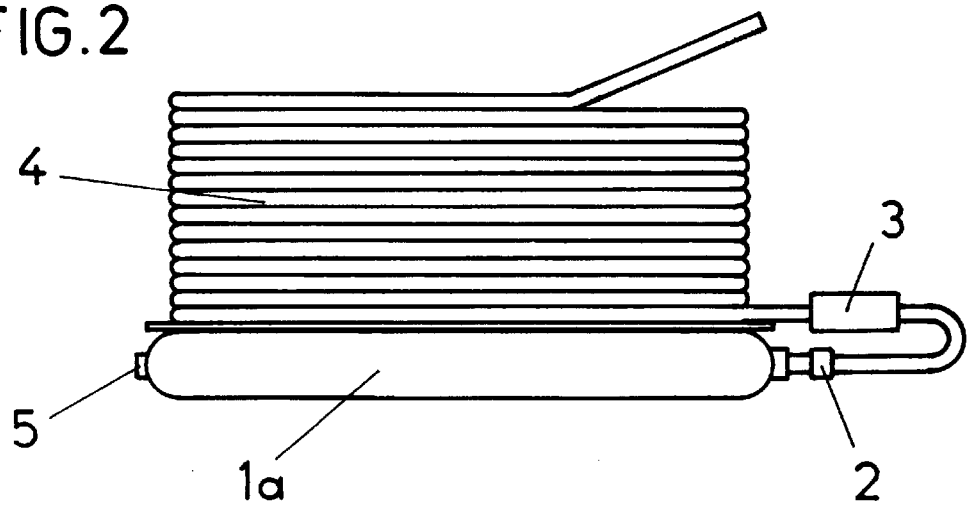

APPARATUS FOR SCAVENGING COLD-DRAWN, COIL-FORMING TUBES IN A ROLLER HEARTH FURNACE

This invention relates to an apparatus for scavenging cold-drawn, coil-forming tubes in a roller hearth furnace.

Cold-drawn tubes generally have residues of drawing compound on their inner surface. In particular in the case of light or nonferrous metal, the tubes can achieve a length of several 100 m. To protect copper tubes against pit corrosion, scavenging with protective gas, generally with a $N_2/H_2/O_2/Ar$ mixture, is effected in a roller hearth furnace before or during the heat treatment, by introducing this mixture into one end of the tube.

Supplying the protective gas for scavenging purposes prior to the heat treatment of the tube is effected manually from outside the furnace, where the composition of the protective gas is chosen such that during the heat treatment a decrease of the C content on the inner surface of the tube is reduced to $\leqq 0.01$ mg/dm$^2$ (DE-OS 30 04 455).

Scavenging during the heat treatment is of course also known. This is effected by means of a protective-gas coupling system disposed at the furnace wall such that a gas-tight connection with the conveyor grid carrying the material to be annealed is created via a coupling lance. Outside the furnace, one end of the tube is then connected with the gas coupling member of the grid. In this way it is possible to press protective gas at high pressure through the tube at certain points of the furnace. Residues of drawing compound on the inner wall of the tube are reduced and supplied to the furnace atmosphere at the other end of the tube, where a $H_2/N_2$ mixture is normally used as scavenging agent.

Scavenging by hand involves a considerable effort. Scavenging during the heat treatment of the tube requires a special furnace structure.

It is the object underlying the invention to eliminate these deficiencies and create a simple apparatus which does not require any conversions of the currently used furnaces and in the case of new installations can do without a protective-gas coupling device at the furnace walls.

This object is met by the invention in that there is provided a pressure vessel serving as reservoir for the scavenging agent, comprising a small calculable outlet hole and a coupling member connected with the tube coil.

The pressure vessel serving as reservoir outside the furnace is filled with protective gas to a certain pressure, which through the calculable small opening supplies the protective gas at a critical outflow rate through the coupling system to the tube coil. Due to the pressure release, the vessel volume and the pressure at the beginning of the heat treatment, it is easily possible to achieve a sufficient supply of protective gas without the necessary scavenging time. Due to the heating process, both the pressure vessel and the the protective gas are heated, and the scavenging process in the furnace is prolonged.

A special pressure vessel need not necessarily be provided, but it is very well possible that the conveyor grid of the furnace at least partly constitutes a gas-tight welded tube structure and serves as pressure vessel.

In the case of larger plants it may be advantageous for simplification purposes to connect two or more tube coils to the pressure vessel.

In the drawing, the subject-matter of the invention is represented by way of example and purely schematically, wherein:

BRIEF DESCRIPTION OF THE DRAWINGS

FIG. 1 shows the essential aspects of a roller hearth furnace in a top view, and FIG. 2 shows a constructional variant in a side view.

As shown in FIG. 1, outside the actual furnace a pressure vessel 1 is provided, which as a reservoir for the scavenging agent (protective gas) has been filled to a predetermined pressure, and from which the protective gas is supplied to the tube coil 4 through a small calculable opening 2 and a coupling system 3. The reference numeral 5 designates the filling hole, which may of course also be disposed at some other point.

As shown in FIG. 2, the conveyor grid 6 constitutes a gas-tight welded tube structure and in turn serves as pressure vessel 1*a*. The pressure vessel 1, 1*a* may be filled with a liquid, which evaporates during the treatment. As degreasing agent, there may for instance be used a water/alcohol mixture.

I claim:

1. An apparatus for scavenging at least one cold-drawn tube coil in a roller hearth furnace, which comprises a conveyor grid at least partly constituting a gas-tight welded tube structure acting as a pressure vessel serving as a reservoir for a scavenging agent, and having a small calculable outlet opening, and a coupling member connecting outlet opening with the tube coil.

2. The apparatus of claim 1, wherein at least two tube coils are connected to the outlet opening.

* * * * *